US006536896B1

(12) United States Patent
Kan

(10) Patent No.: US 6,536,896 B1
(45) Date of Patent: Mar. 25, 2003

(54) MEDIA FEED ASSEMBLY WITH DOUBLE PINCHING ROLLERS

(75) Inventor: Kok Hong Kan, Singapore (SG)

(73) Assignee: Venture Manufacturing (Singapore) Ltd., Techplace II (SG)

( * ) Notice: Subject to any disclaimer, the term of this patent is extended or adjusted under 35 U.S.C. 154(b) by 0 days.

(21) Appl. No.: 09/949,063

(22) Filed: Sep. 7, 2001

(51) Int. Cl.[7] ..... B41J 13/042; B41J 13/036

(52) U.S. Cl. ..... 347/104; 347/218; 400/637.4; 400/637.5

(58) Field of Search ..... 400/617, 636, 400/636.3, 637, 637.3, 637.4, 637.1, 637.5, 637.6, 638, 639; 347/104, 218; 346/134, 136

(56) References Cited

U.S. PATENT DOCUMENTS 4,280,693 A 7/1981 Matsuhisa et al.
4,408,917 A 10/1983 Iwai et al.
4,486,108 A 12/1984 Tanaka
5,363,129 A 11/1994 Kline et al.
5,530,459 A 6/1996 Kline et al.
5,938,356 A 8/1999 Wirth et al.

*Primary Examiner*—Huan Tran
(74) *Attorney, Agent, or Firm*—Akin Gump Strauss Hauer & Feld, L.L.P.

(57) ABSTRACT

An assembly for feeding media associated with a printer or other media manipulating device includes a feed roller and first and second roller support members that rotatably mount first and second pinch rollers, respectively. The pinch rollers apply pressure to media on the feed roller at spaced pinch locations to increase the contact area between the media and the feed roller. One of the roller support members is movable with respect to the other of the roller support members to vary the distance between the first and second pinch locations and stretch the media on the feed roller during media loading.

21 Claims, 7 Drawing Sheets

$\theta' > \theta$

MEDIA FEED ASSEMBLY WITH DOUBLE PINCHING ROLLERS

BACKGROUND OF THE INVENTION

This invention relates to a media feed assembly for a label/tag printer or other media manipulating device for loading, holding, advancing, and retracting media in the device.

Inkjet printers typically include a media advancing assembly and a print head that repeatedly moves in a path that is transverse to the direction of the advancing media. After every pass of the print head, the media advances a distance equal to the width of a print swath. The direction and amount of media travel is typically controlled by a processor that sends signals to a drive mechanism associated with a media feed roller. In response to control signals from the processor, the feed roller is caused to rotate a predetermined amount and, together with a set of pinch rollers, pinch and feed the media an amount desired for printing, cutting, and/or other operations. The print head typically has an array of four nozzles, with each nozzle representing a different color to be applied to the media, e.g. cyan, magenta, yellow, and black. In order to obtain millions of colors, two or more of the nozzles may be directed to deposit ink at the same location on the media or the nozzles may be directed to deposit ink at a precise location with respect to deposits from other nozzles. Hence, the accuracy of media advancement is of prime importance to the quality of the resulting print. Under-advancement of the media will cause the print swaths to overlap, while over-advancement of the media will cause the print swaths to be separated.

The accuracy of media advancement is affected by slippage that can occur between the media and the feed roller. In order to prevent slippage, good traction between the media and feed roller is necessary. Good traction is dependent on many factors, such as the pinch pressure exerted by the pinch rollers on the feed roller, the coefficient of friction between the media and the feed roller, the acceleration of the feed roller, as well as forward and rearward tension forces acting on the media.

In the on-demand label/tag printing industry, the printing media is normally either in the form of a continuous roll or a continuous folded stack of labels/tags. Prior to printing, the media from the roll or stack is typically fed through the printer until a forward edge of the media exits the feed roller at a position under the print head. In most instances, the pinch rollers must be released from the feed roller to ensure that the media can be loaded without obstruction. Once the media is loaded, the pinch rollers are lowered to thereby "pinch" or compress the media against the feed roller.

Many printers have an elaborate feed path with one or more turns that are prone to loading or feeding errors, such as buckling and jamming of the media, as it is fed through the printer. In addition, one or more turns in the feed path may cause delamination of die-cut labels from their backing sheets, especially when the label is on the outside of a turn. In addition, air pockets between the label and backing sheet can occur as the media curvature changes direction during travel along the feed path.

Although these problems are substantially reduced or eliminated with the provision of a generally linear or straight-line feed path between the continuous roll or folded stack and the feed roller, several other problems may arise. In particular, when adhesive label media with a backing sheet are used, slippage between the feed roller and the label media can occur since the coefficient of friction between the relatively slick backing sheet and the feed roller is comparatively less than the coefficient of friction between plain paper media and the feed roller. In order to prevent slippage, a much higher pinch pressure on the adhesive label is needed than on the plain paper media. However, the higher pinch pressure can deform the media as well as the feed roller, which is typically constructed of rubber, and reduce the effective diameter of the feed roller. Consequently, the media tends to be under-advanced which in turn causes the print swaths to overlap.

Continuous media in an inkjet printer is often subject to tension in the forward and backward directions with respect to the feed roller. Backward tensioning may occur when media is pulled from a supply roll, while forward tensioning may occur when the printed media is wrapped over an edge to dispense the die cut label. Media tensioning, whether forward or backward, can reduce the grip between the media and the drive roller and lead to slippage. Hence, higher pinch pressures are necessary to counteract the negative tensioning effects. Again, the higher pinch pressures can deform the media and the feed roller, leading to overlapping print swaths.

A further problem arises when the media is subjected to a series of discontinuous start/stop cycles during printing. As the feed roller rotates through cycles of high acceleration and deceleration for every print swath, the sudden pull of the media at the beginning of a cycle together with the back tension on the media results in media slippage if the pinch pressure is insufficient. This is even more pronounced with higher throughput requirements of inkjet printers designed for the high speed label printing industry when compared to inkjet printers designed for home or office use. Consequently, a relatively high pinch pressure is needed to reduce slippage and ensure accuracy of the media position during printing.

Media skewing is also a problem associated with inkjet printers since there is typically only a single line of contact between the media and the feed roller and pinch rollers. Media skewing is largely dependent on the parallelism between the feed roller and pinch rollers. When the feed roller and pinch rollers are not parallel, the line of contact between the feed roller and pinch rollers will be skewed, resulting in media skewing as well. In order to ensure parallel alignment between the feed roller and pinch rollers, relatively tight tolerances in the related parts are required.

SUMMARY OF THE INVENTION

According to the invention, an assembly for feeding media associated with a printer or other media manipulating device is provided. The assembly comprises a media feed roller adapted for rotational movement about a feed roller axis, a first roller support member with a first pinch roller mounted for rotational movement about a first pinch roller axis, and a second roller support member with a second pinch roller mounted for rotational movement about a second pinch roller axis. The first and second pinch rollers are positionable for applying pressure to the feed roller at first and second pinch locations, respectively. One of the roller support members is movable with respect to the other of the roller support members to thereby vary the distance between the first and second pinch locations.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings.

The invention will now be described in greater detail with reference to the drawings, wherein like parts throughout the drawing figures are represented by like numerals.

DETAILED DESCRIPTION OF THE INVENTION

Figure 1:
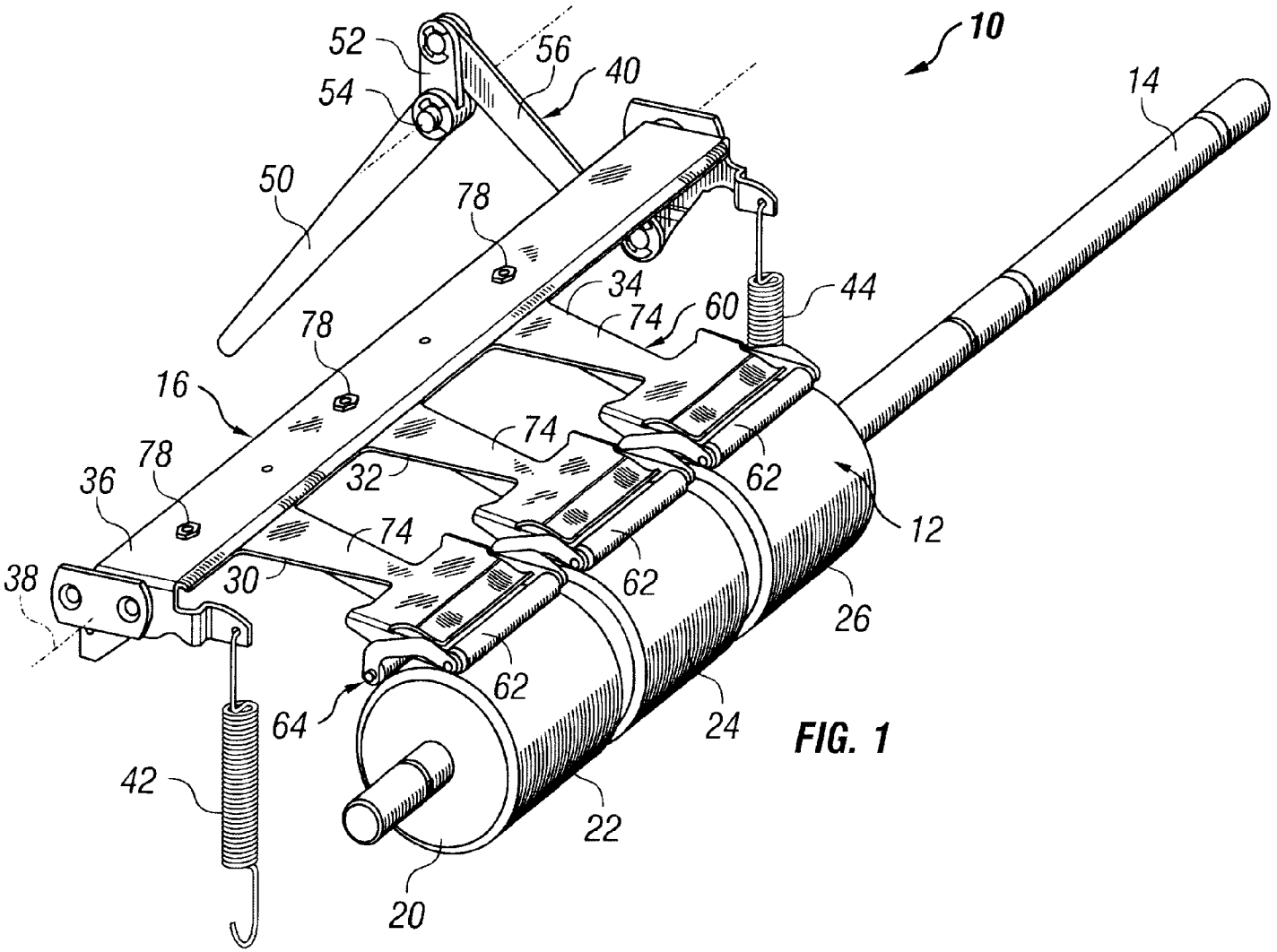
FIG. 1 is an isometric view of a media feed assembly with a feed roller and a pinch roller assembly according to the present invention.
Figure 2:
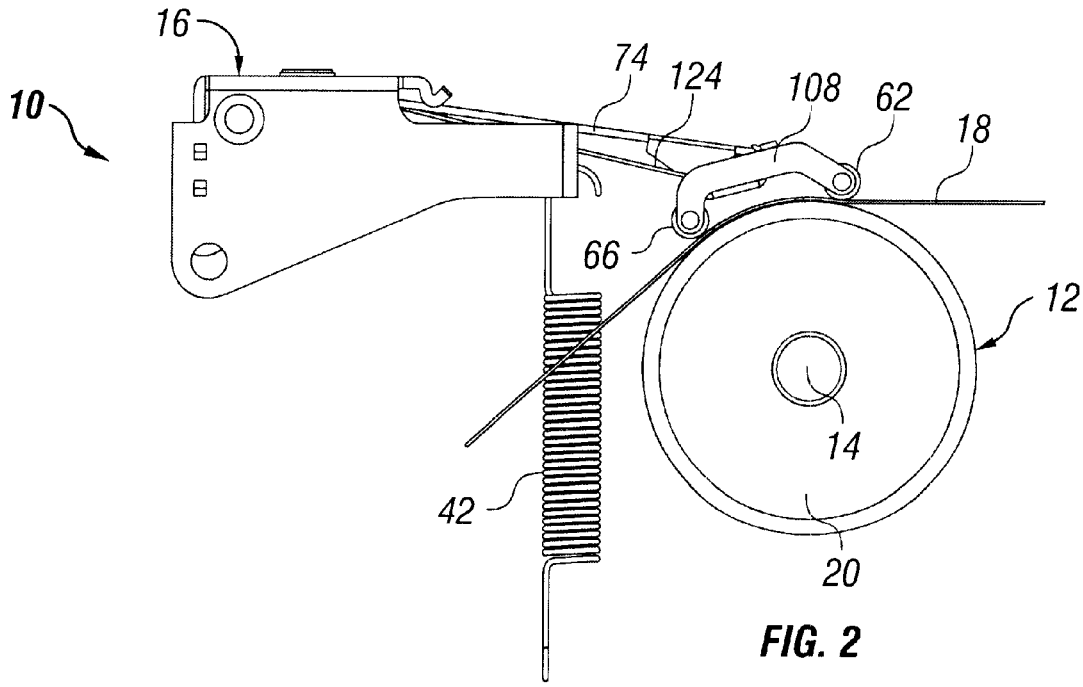
FIG. 2 is a side elevational view of the media feed assembly in a lowered position.

Referring now to the drawings, and to FIG. 1 in particular, a media feed assembly 10 according to an embodiment of the present invention is illustrated. The media feed assembly 10 comprises a feed roller 12 mounted for rotation with a drive shaft 14, and a pinch roller assembly 16 that cooperates with the feed roller 12 for moving a sheet of media 18 (FIG. 2), such as media to be printed on and/or cut, along a feed path.

The feed roller 12 preferably includes a hollow cylindrical portion 20 that engages the drive shaft 14 and axially spaced sleeves 22, 24 and 26 that extend around the cylindrical portion 20. Preferably, the sleeves 22, 24 and 26 are constructed of an elastomeric material, such as rubber, to provide high frictional engagement with the printing media 18. Although three separate elastomeric sleeves are shown, it will be understood that more or less sleeves can be provided. By way of example, a single sleeve can extend across the length of the cylindrical portion 20.

Figure 3:
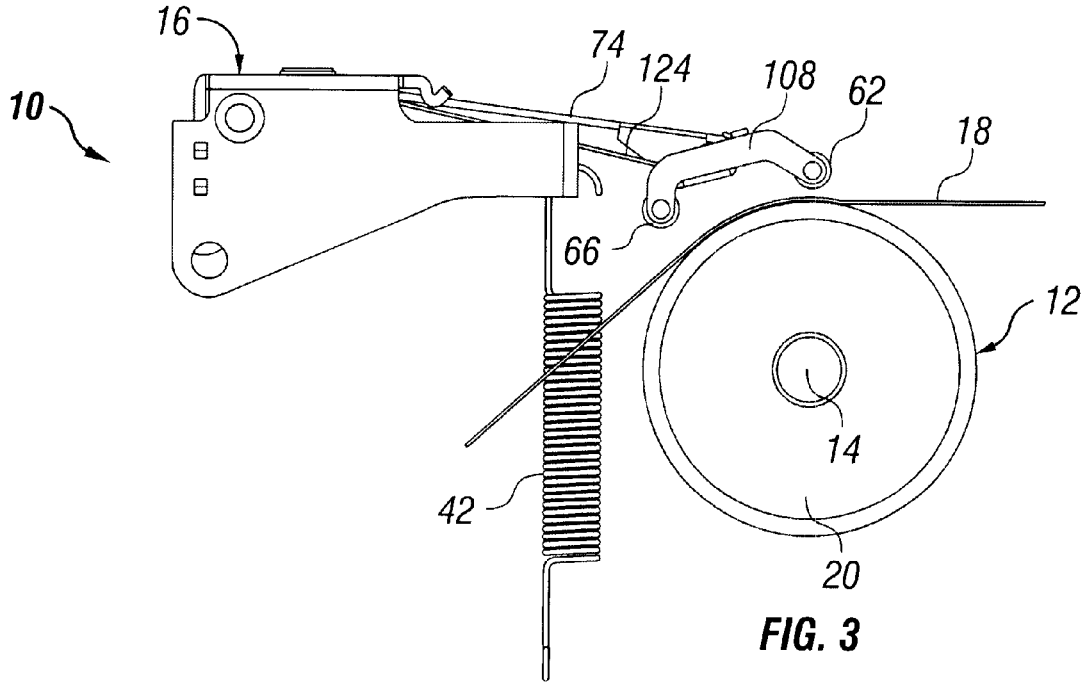
FIG. 3 is a side elevational view of the media feed assembly in a raised position.

The pinch roller assembly 16 preferably includes a plurality of pinch roller support members 30, 32 and 34 that extend from a cross bar 36 in cantilever fashion. The cross bar 36 is adapted to pivot about a longitudinal cross bar axis 38 in response to movement from a linkage assembly 40 to thereby pivot the pinch roller support members between a lowered position (FIG. 2) for pinching the media 18 and a raised position (FIG. 3) that provides a clear path for loading the media prior to a printing, cutting and/or feeding operation. Extension springs 42 and 44 are connected to the cross bar 36 for biasing the pinch roller support members to the lowered position.

The linkage assembly 40 includes a lever arm 50 that can be manipulated by a user for raising and lowering the pinch roller support members. The lever arm 50 is mounted for pivoting movement with respect to printer support structure (not shown) at a pivot joint 54. A first link arm 52 is connected to the lever arm 50 for pivoting movement therewith. A second link arm 56 is pivotally connected at one end to the first link arm 52 and at an opposite end to the cross bar 36. In this manner, upward and downward pivoting movement of the lever arm 50 causes pivoting movement of the cross bar 36 between the raised and lowered positions, respectively.

Figure 5:
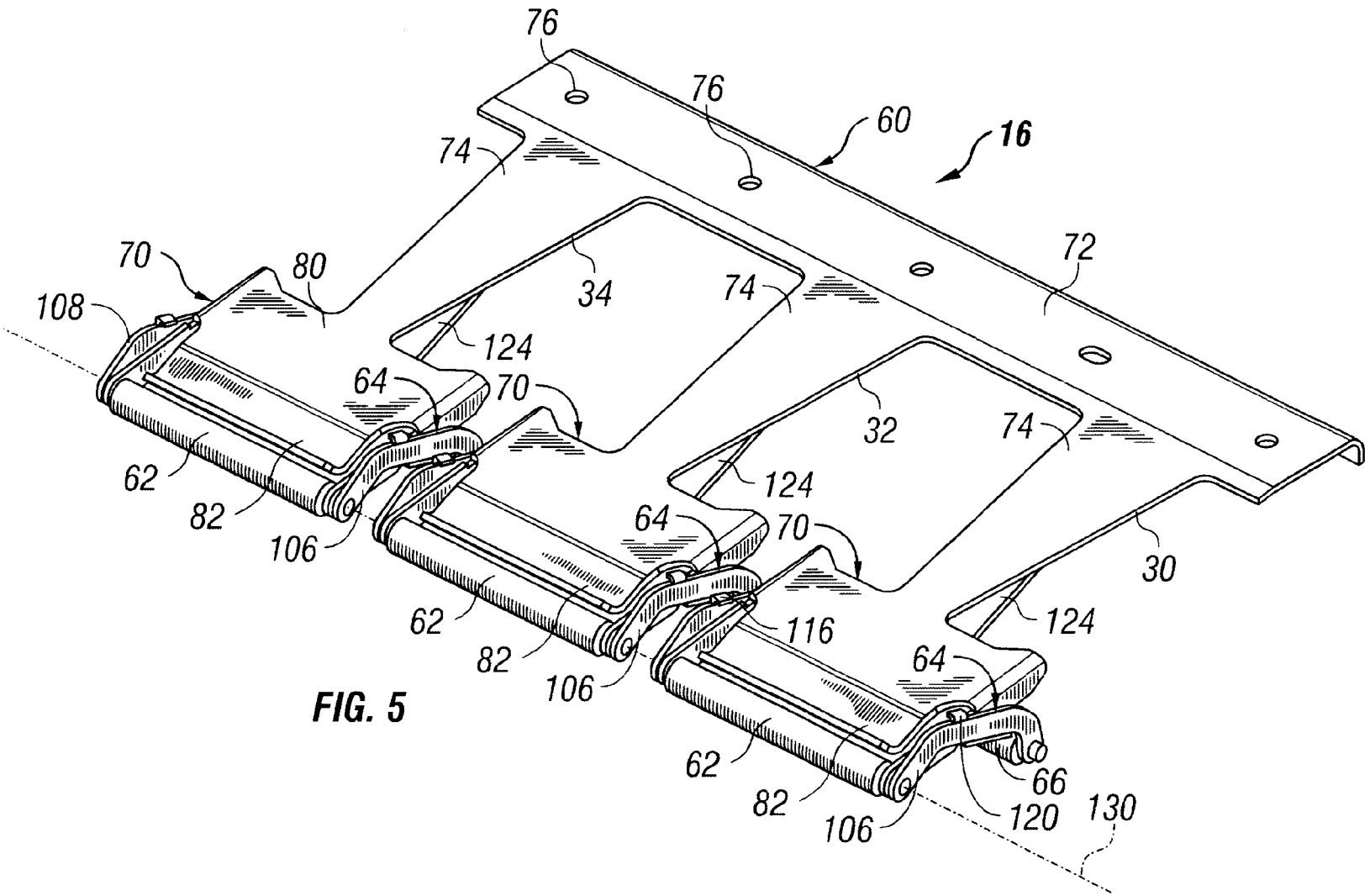
FIG. 5 is an isometric view of the pinch roller assembly with primary and secondary pinch roller support members according to the present invention.

With further reference to FIG. 5, each of the pinch roller support members 30, 32 and 34 of the assembly 16 includes a primary roller support 60 that rotatably supports primary pinch rollers 62, and a secondary roller support 64 that rotatably supports secondary pinch rollers 66. Preferably, the primary and secondary roller supports are pivotally connected together, as will be described in greater detail below.

The primary and secondary pinch rollers advantageously increase the surface area contact between the media 18 and the drive roller 12 to thereby reduce skewing and slippage of the media. Compressive forces on the printing media and the drive roller are distributed over the primary and secondary pinch rollers to thereby reduce or eliminate distortion of the media and drive roller with its consequent problems, as discussed above.

Figure 4A:
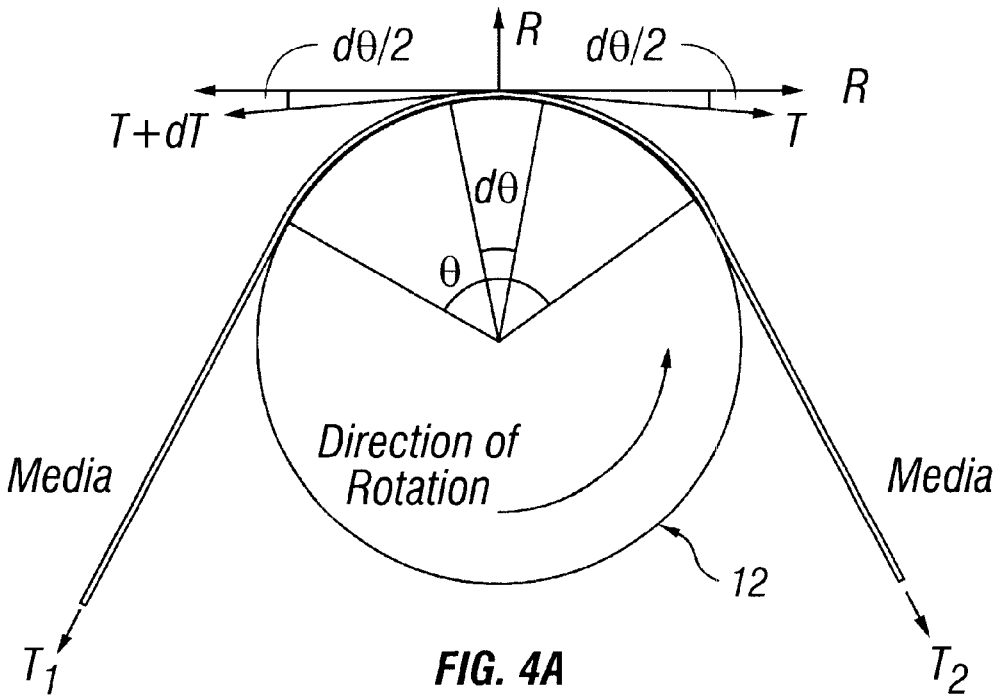
FIG. 4A is a schematic diagram of forces present in the feed roller and media with increased surface contact between the feed roller and media.

With reference now to FIG. 4A, the primary pinch rollers together with the secondary pinch rollers wrap the media on the feed roller over an arc length characterized by the subtended angle θ. This wrapping action significantly increases the traction between the media and feed roller, as demonstrated by the following mathematical exercise.

Consider an element, such as a sheet of printing media, in contact with the feed roller over a variable arc length, as represented by the subtended angle dθ. Resolving forces radially, $$R=(T+dT)d\theta/2+Td\theta/2 \tag{1}$$

where T is the tensile force acting on the media sheet 18, dT is the change in tensile force, and R is the radial force acting on the sheet and the feed roller. Simplifying, $$R=Td\theta+dTd\theta/2 \tag{2}$$

and ignoring the second order derivative, $$R=Td\theta \tag{3}$$

Also, resolving forces tangentially, $$\mu R=(T+dT)-T \tag{4}$$

where $\mu$ is the coefficient of friction between the media sheet 18 and the feed roller 12. Simplifying, $$\mu R=dT \tag{5}$$

and substituting for R, $$dT=\mu Td\theta \tag{6}$$

Integrating and solving, $$\int dT/T=\mu\int d\theta \tag{7}$$

$$ln\ T_1 - ln\ T_2 = \mu\theta \quad (8)$$

$$T_1/T_2 = e^{\mu\theta} \quad (9)$$

Figure 4B:
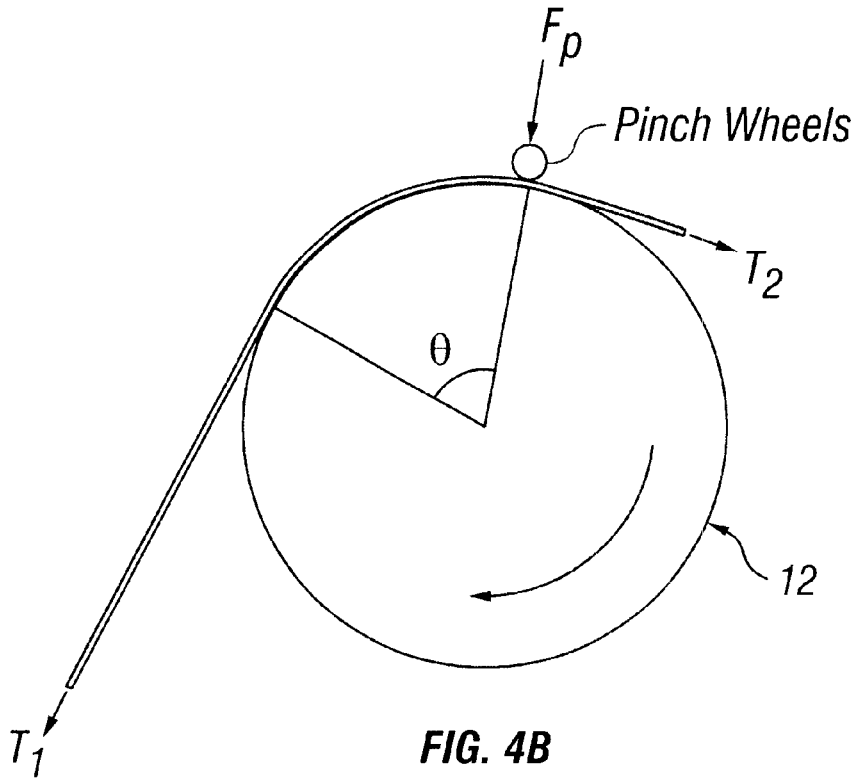
FIG. 4B is a schematic diagram similar to FIG. 4A, with the addition of a pinch force from the pinch roller assembly.

With pinching, as shown in FIG. 4B, a pinching force Fp is present. Thus, the tensile force for back slippage is:

$$T_1 = (T_2 + \mu Fp)e^{\mu\theta} \quad (10)$$

and the tensile force for forward slippage is:

$$T_2 = (T_1 + \mu Fp)e^{\mu\theta} \quad (11)$$

Without wrapping, i.e. $\theta=0$ rad., such as when the printing media contacts the drive roller along a single line of contact, the tensile force for back slippage is:

$$T_1 = (T_2 + \mu Fp) \quad (12)$$

and the tensile force for forward slippage is:

$$T_2 = (T_1 + \mu Fp) \quad (13)$$

As can be seen by the above expressions, the traction force is increased exponentially by a factor $e_{\mu\theta}$ with media wrapping around the feed roller 12, characterize by the angle $\theta$. Thus, the larger the wrap angle $\theta$, the larger the traction force between the media 18 and the feed roller 12. Accordingly, the primary and secondary pinch rollers of the present invention increase the traction force between the media and the feed roller in an exponential manner.

Figure 6:
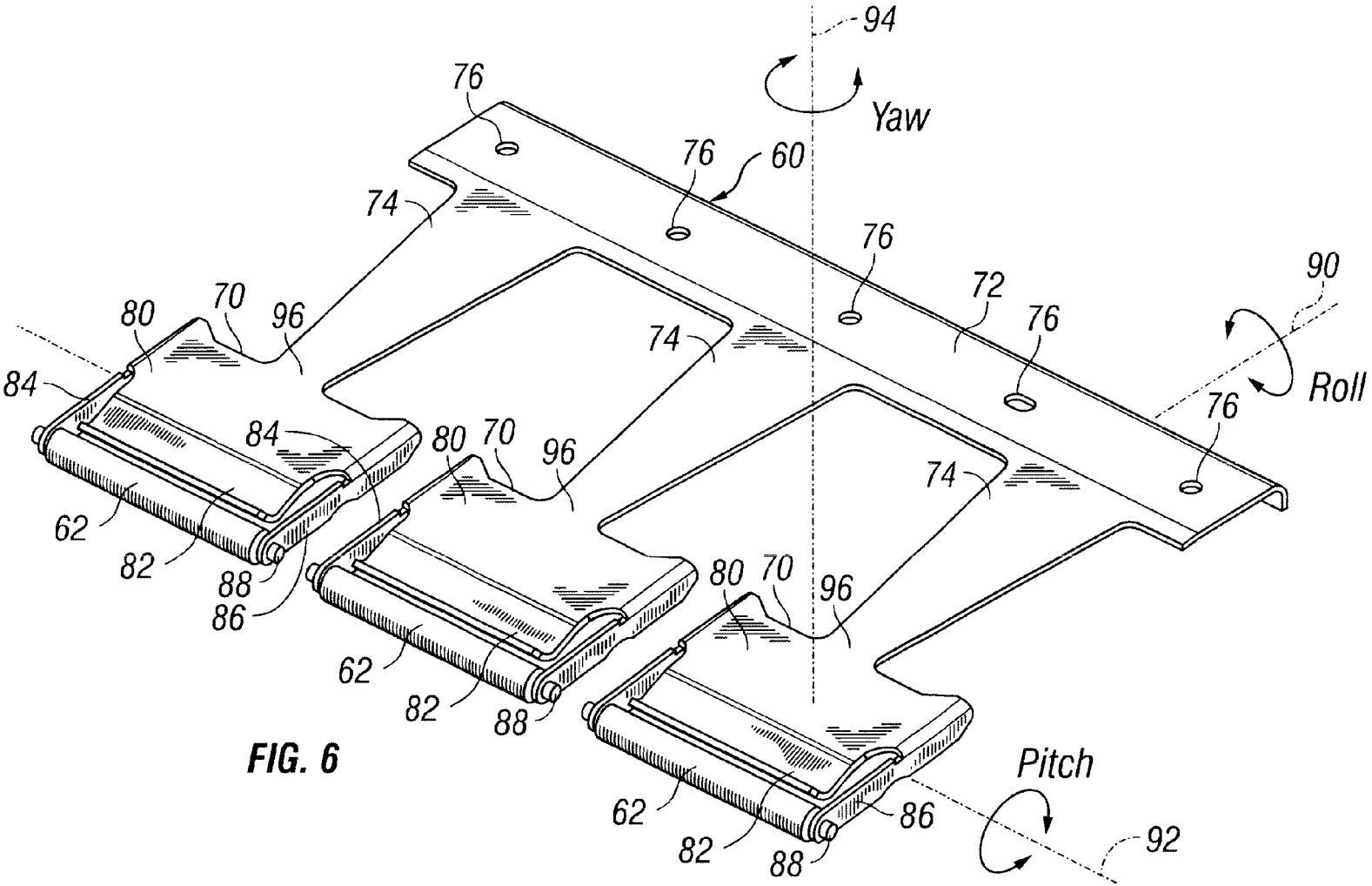
FIG. 6 is an isometric view of the primary pinch roller support member.

With reference now to FIG. 6, the primary roller support 60 includes forward roller mounting brackets 70 for each of the primary pinch rollers 62. Each bracket 70 is connected to a mounting strip 72 through a cantilevered primary load arm 74. The mounting strip 72 includes apertures 76 that receive fasteners 78 (FIG. 1) for mounting the primary roller support 60 to the cross bar 36. Each bracket 70 includes an upper wall 80 with a depressed section 82 and a pair of side walls 84 and 86 that extend downwardly from the upper wall 80. Each side wall has an opening (not shown) for receiving the ends of a shaft 88 onto which a pinch roller 62 is mounted. Preferably, the distance between the side walls 84 and 86 is less than the length of the shaft 88 such that the shaft extends beyond the side walls a predetermined distance. The shafts 88 can be retained on their respective brackets 70 through C-clips or other well known shaft retaining means. The depressed sections 82 serve to guide the printing media 18 (FIG. 2) during loading.

Preferably, the primary roller support 60, including the mounting brackets 70, the mounting strip 72, and the cantilevered primary load arm 74, is stamped and formed from a sheet of steel, such as stainless steel or other material that exhibits spring-like properties. It will be understood that other materials and/or forming techniques can be used to construct the primary roller support 60, and that the mounting brackets 70, the mounting strip 72, and the cantilevered primary load arm 74 can be formed separately and connected together. The resilient nature of the primary load arm ensures that the primary pinch rollers 62 will apply proper pinch pressure to the media 18 and the feed roller 12. In a further embodiment of the invention, a compression, tension or torsion spring can be used to apply the proper pinch pressure.

Preferably, the cantilevered primary load arm 74 is shaped to permit roll of the pinch rollers 62 about a roll axis 90 and pitch about a pitch axis 92 which is perpendicular to the roll axis 90, yet resist yaw about a yaw axis 94 which is perpendicular to the pitch and roll axes, as illustrated in FIG. 6, to thereby permit limited pivotal movement in two degrees of freedom. The rolling action is achieved by providing a triangular-shaped primary load arm 74 that narrows in width from the mounting strip 72 toward the mounting bracket 70 to form a neck portion 96 at a predetermined distance from the pinch rollers 62. The triangular shape permits roll about the axis 90 without compromising the bending stiffness of the primary load arm.

The rolling and pitching action of the pinch rollers 62 ensure that they individually conform to the surface of the feed roller and maintain an even pinch pressure across the feed roller. Preferably, yawing action is prevented when the printing media will be retracted into the printer for edge printing or edge detection of the media. If the primary load arms were shaped to permit yaw during retraction of the media, the load arms, and hence the pinch rollers, would side skew and cause the media to side skew as well. It will be understood that the primary load arms 74 can be shaped to permit yawing action when the printing media will be fed only in the forward direction.

Figure 7:
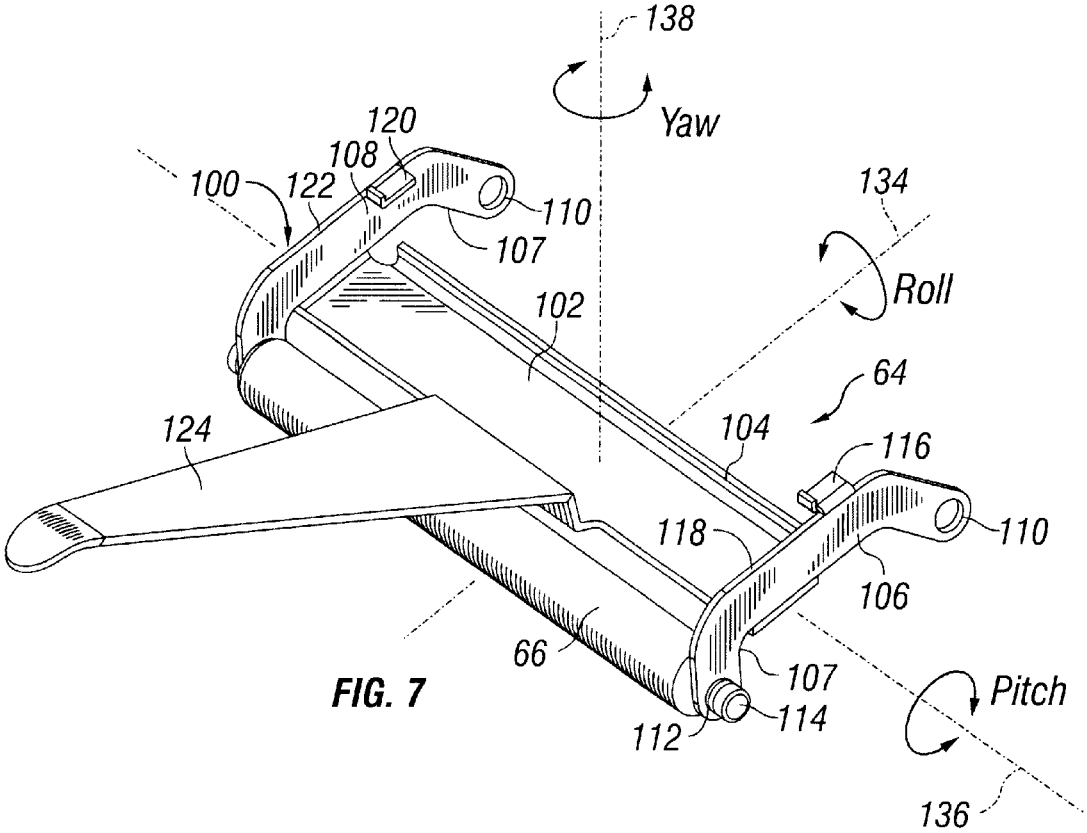
FIG. 7 is an isometric view of the secondary pinch roller support member.

With reference now to FIG. 7, each of the secondary roller supports 64 includes a rearward roller mounting bracket 100 for each of the secondary pinch rollers 66. Each bracket 100 includes a lower wall 102 with an upwardly extending flange 104 and a pair of secondary load arms 106 and 108 that extend upwardly from opposite ends of the lower wall 102. Each secondary load arm 106 and 108 has a forward opening 110 for receiving the ends of the shaft 88 (FIG. 6) that project outwardly from the side walls 84 and 86 of the forward roller mounting bracket 70. A rearward opening 112 is also formed in each secondary load arm 106 and 108 for receiving the ends of a shaft 114 onto which a secondary pinch roller 66 is mounted. As with the primary roller support 60, the shafts 114 can be retained on their respective rearward brackets 100 through C-clips or other well known shaft retaining means. The lower surfaces 107 of the secondary load arms 106 and 108 between the primary and secondary pinch rollers provide an upper guide for the media 18 during media loading. A first stop tab 116 extends inwardly from an upper edge 118 of the secondary load arm 106 and a second stop tab 120 extends inwardly from an upper edge 122 of the secondary load arm 108. A tongue 124 extends upwardly and rearwardly from the lower wall 102 and is adapted to engage a lower surface of the primary load arm 74 (FIG. 6) when the secondary roller support 64 is mounted to the primary roller support 60.

Preferably, the secondary roller support 64, including the bottom wall 102, secondary load arms 106 and 108, stop tabs 116 and 120, and the tongue 124, are stamped and formed from a sheet of steel, such as stainless steel or other material that exhibits spring-like properties. It will be understood that other materials and/or forming techniques can be used to construct the secondary roller support 64, and that the various parts can be formed separately and connected together. The resilient nature of the tongue 124 ensures that the secondary pinch rollers 66 will apply proper pinch pressure to the media 18 and the feed roller 12. In a further embodiment of the invention, the tongue 124 can be replaced with a compression, tension or torsion spring to apply the proper pinch pressure.

As shown in FIG. 5, the secondary roller support 64 preferably pivots about the rotational axis 130 of the primary pinch rollers 62. Pivoting movement of the secondary roller support 64 about the axis 130 in both the raised and lowered positions is limited by the tab stops 116 and 120. The spring action of the tongue 124 normally biases the secondary pinch rollers 66 in a downward position with respect to the primary pinch rollers 62 to thereby press the media against the feed roller 12. According to a further embodiment of the invention, the secondary roller support 64 can be adapted for pivoting about an axis other than the rotational axis 130.

The secondary roller support 64 is also preferably arranged to permit pivoting movement of the secondary pinch rollers 66 about a roll axis 134 and a pitch axis 136, yet resist pivoting movement about a yaw axis 138, as illustrated in FIG. 7, to thereby permit limited pivotal movement in two degrees of freedom. The rolling action is achieved by flexure of the secondary load arms 106, 108, while the pitching action is achieved by pivotal movement of the secondary load arms 106, 108 about the axis 130 (FIG. 5) of the primary pinch rollers 62. Thus, the pitch axis 136 is preferably coincident with the axis 130. The rolling and pitching action of the secondary pinch rollers 66 ensure that they individually conform to the surface of the feed roller 12 and maintain an even pinch pressure across the feed roller. Preferably, yawing action is prevented when the printing media will be retracted into the printer for edge printing or edge detection of the media in order to prevent side skew of the media. It will be understood that the secondary roller support can be arranged to permit yawing action when the printing media will be fed only in the forward direction.

Due to the resilient nature of the secondary load arms, each secondary roller support 64 can be connected to the primary roller support 60 in a snap-fit engagement between the secondary load arms 106, 108 and the shaft 88. Likewise, each secondary roller support 64 can be disconnected from the primary roller support 60 by flexing one or more of the secondary load arms 106 and 108 until the forward openings 110 are free of their respective shaft 88. In this manner, the secondary pinch rollers 66 can be removed in a relatively easy manner to accommodate the straight-through feeding of relatively stiff media through the printer. Distortion of the media that may otherwise occur due to media wrapping over a relatively large surface area of the feed roller can therefore be avoided.

Figure 8:
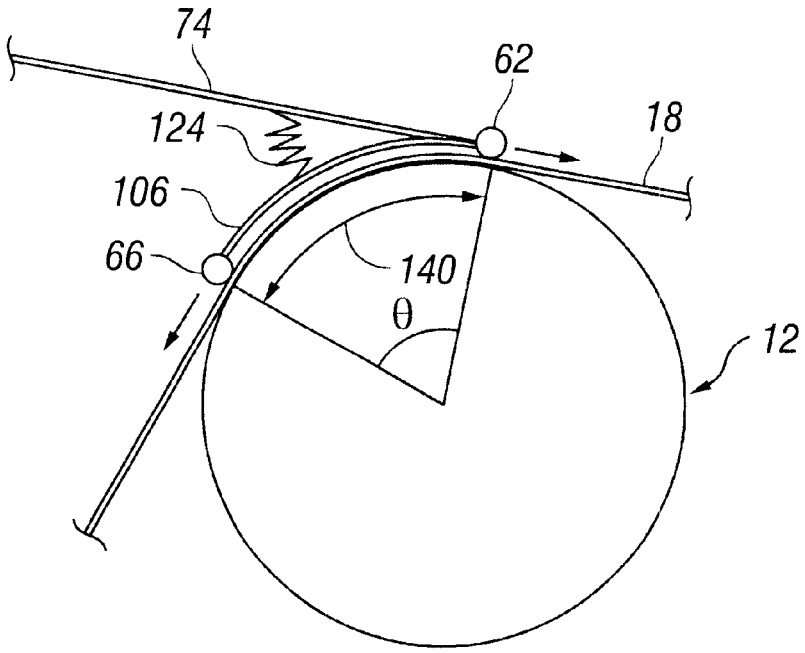
FIG. 8 is a schematic side view of the media feed assembly when primary and secondary pinch rollers of the pinch roller assembly first contacts the media.
Figure 9:
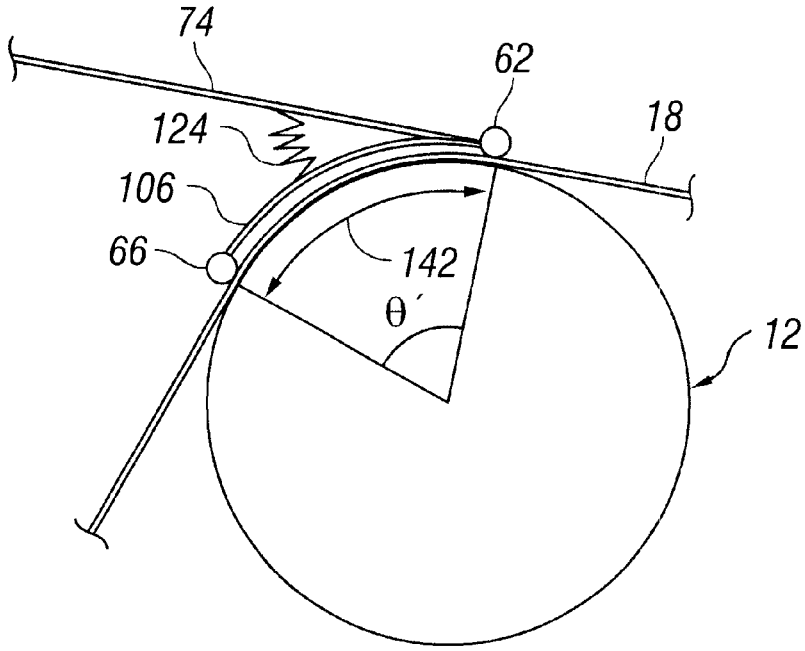
FIG. 9 is a schematic side view similar to FIG. 8 with the media stretched between the primary and secondary pinch rollers.

With reference now to FIGS. 8 and 9, a further feature of the invention is illustrated in schematic form. When the primary and secondary pinch rollers 62, 66 first contact the media 18 on the feed roller 12 as shown in FIG. 8, the pinch rollers are spaced apart a first distance or arc length 140. The pinch rollers in this position do not apply the pinch pressure required for a feeding operation of the media. Further pressure against the media 18 and feed roller 12 occurs under bias of the springs 42, 44 (FIG. 1) to thereby spread the pinch rollers 62, 66 apart a second distance or arc length 142 over the curved surface of the feed roller 12 that is greater than the first distance or arc length 140, until full pressure is applied. The relative movement between the pinch rollers 62, 66 and the feed roller 12 stretches and holds the media 18 against the feed roller while preventing media bulge that may otherwise occur between the pinch rollers.

It will be understood that the terms forward, rearward, upward, downward, raised, lowered, inwardly, outwardly, and their respective derivatives and equivalent terms as may be used throughout the specification refer to relative, rather than absolute orientations and/or positions.

While the invention has been taught with specific reference to the above-described embodiments, those skilled in the art will recognize that changes can be made in form and detail without departing from the spirit and the scope of the invention. By way of example, although the invention has been taught for use with high speed inkjet printers, it will be understood that the media feed assembly can be used with other printers or media manipulating devices that require media feeding for printing, cutting, embossing, laminating, and/or other operations. Thus, the described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

I claim:

1. An assembly for feeding media associated with a printer or other media manipulating device, the assembly comprising:

a feed roller adapted for rotational movement about a feed roller axis for controlling position of the media;

a first roller support member having a first pinch roller mounted for rotational movement about a first pinch roller axis, the first pinch roller being positionable for applying pressure to the feed roller at a first pinch location; and a second roller support member having a second pinch roller mounted for rotational movement about a second pinch roller axis, the second pinch roller being positionable for applying pressure to the feed roller at a second pinch location spaced a distance from the first pinch location;

wherein one of the roller support members is movable with respect to the other of the roller support members to thereby vary the distance between the first and second pinch locations.

2. An assembly according to claim 1, wherein the second roller support member is pivotal with respect to the first roller support member about a pivot axis.

3. An assembly according to claim 2, wherein the pivot axis is coincident with the first pinch roller axis.

4. An assembly according to claim 2, wherein pivotal movement between the first and second roller support members about the pivot axis causes the first and second pinch rollers to engage and stretch the media on the feed roller.

5. An assembly according to claim 1, and further comprising a cross bar adapted for pivotal movement between raised and lowered positions, the first and second roller support members being connected to the cross bar for movement between the raised position for loading media and the lowered position for controlling position of the media during a media manipulating operation.

6. An assembly according to claim 5, wherein the first roller support member comprises a first load arm that extends from the cross bar in cantilevered fashion and a mounting bracket connected to the first load arm that rotatably receives the first pinch roller.

7. An assembly according to claim 6, wherein the second roller support member comprises a pair of spaced second load arms that rotatably receive the second pinch roller there between.

8. An assembly according to claim 7, wherein the second load arms are pivotally connected to the mounting bracket of the first roller support member about a pivot axis.

9. An assembly according to claim 8, wherein the pivot axis is coincident with the first pinch roller axis.

10. An assembly according to claim 9, wherein the second roller support member further comprises a wall extending between the second load arms and a tongue extending from the wall, the tongue being in contact with the first load arm.

11. An assembly according to claim 10, wherein the first load arm and the tongue are constructed of a resilient material, such that movement of the first and second roller support members to the lowered position causes the first and second pinch rollers to resiliently engage the media when present on the feed roller.

12. An assembly according to claim 9, wherein pivotal movement between the first and second roller support members about the pivot axis causes the first and second pinch rollers to engage and stretch the media on the feed roller.

13. An assembly according to claim 9, wherein the first load arm is shaped to permit limited pivotal movement of the first pinch roller about a first pitch axis that is at least substantially parallel to the first pinch roller axis and about a first roll axis that is perpendicular to the first pitch axis, such that the first pinch roller is self-aligning with the feed roller despite initial deviation between the first pinch roller axis and the feed roller axis.

14. An assembly according to claim 13, wherein the first load arm increases in width from the mounting bracket to the cross bar to thereby permit limited pivotal movement of the first pinch roller about the first roll axis.

15. An assembly according to claim 13, wherein the second load arms are shaped to permit limited pivotal movement of the second pinch roller about a second pitch axis that is at least substantially parallel to the first pinch roller axis and about a second roll axis that is perpendicular to the second pitch axis, such that the second pinch roller is self-aligning with the feed roller despite initial deviation between the second pinch roller axis and the feed roller axis.

16. An assembly according to claim 15, wherein the second pitch axis is coincident with the first roller axis.

17. An assembly according to claim 8, wherein pivotal movement between the first and second roller support members about the pivot axis causes the first and second pinch rollers to engage and stretch the media on the feed roller.

18. An assembly according to claim 1, wherein relative movement between the first and second roller support members causes the first and second pinch rollers to engage and stretch the media on the feed roller.

19. An assembly according to claim 1, wherein the first roller support member is shaped to permit limited pivotal movement of the first pinch roller about a first pitch axis that is at least substantially parallel to the first pinch roller axis and about a first roll axis that is perpendicular to the first pitch axis, such that the first pinch roller is self-aligning with the feed roller despite initial deviation between the first pinch roller axis and the feed roller axis.

20. An assembly according to claim 19, wherein the second roller support member is shaped to permit limited pivotal movement of the second pinch roller about a second pitch axis that is at least substantially parallel to the first pinch roller axis and about a second roll axis that is perpendicular to the second pitch axis, such that the second pinch roller is self-aligning with the feed roller despite initial deviation between the second pinch roller axis and the feed roller axis.

21. An assembly according to claim 1, wherein the second roller support member is releasably connected to the first roller support member.

* * * * *